US011702757B2

(12) United States Patent
Ueno et al.

(10) Patent No.: US 11,702,757 B2
(45) Date of Patent: Jul. 18, 2023

(54) METHOD OF PERFORMING PRE-PAINT TREATMENT OF AUTOMOBILE BODY AND AUTOMOBILE BODY

(71) Applicants: NIPPON PAINT SURF CHEMICALS CO., LTD., Tokyo (JP); HONDA MOTOR CO., LTD., Tokyo (JP)

(72) Inventors: Takayuki Ueno, Tokyo (JP); Yu Koganezawa, Tokyo (JP); Yuki Kasahara, Tokyo (JP); Osamu Izumi, Tokyo (JP); Yuji Ohtake, Tokyo (JP); Yuya Kotani, Tokyo (JP); Koichiro Izumi, Tokyo (JP); Tatsumasa Hidaka, Tokyo (JP); Katsuyoshi Kaneko, Tokyo (JP)

(73) Assignees: NIPPON PAINT SURF CHEMICALS CO., LTD., Tokyo (JP); HONDA MOTOR CO., LTD., Tokyo (JP)

( * ) Notice: Subject to any disclaimer, the term of this patent is extended or adjusted under 35 U.S.C. 154(b) by 0 days.

(21) Appl. No.: 17/702,496

(22) Filed: Mar. 23, 2022

(65) Prior Publication Data

US 2022/0316084 A1 Oct. 6, 2022

(30) Foreign Application Priority Data

Mar. 31, 2021 (JP) ..... 2021-060181

(51) Int. Cl.
*C25D 1/00* (2006.01)
*C25D 13/20* (2006.01)
*C23C 22/34* (2006.01)

(52) U.S. Cl.
CPC ..... *C25D 1/00* (2013.01); *C23C 22/34* (2013.01); *C25D 13/20* (2013.01)

(58) Field of Classification Search
None
See application file for complete search history.

(56) References Cited

U.S. PATENT DOCUMENTS

2015/0176136 A1* 6/2015 Toi ..... C09D 5/002 524/428
2021/0172068 A1* 6/2021 Suzuki ..... B32B 15/01

FOREIGN PATENT DOCUMENTS

JP 2004-218074 A 8/2004

* cited by examiner

*Primary Examiner* — Louis J Rufo
(74) *Attorney, Agent, or Firm* — Muncy, Geissler, Olds & Lowe, P.C.

(57) ABSTRACT

Provided is a method of performing pre-paint treatment of an automobile body including a high-tensile steel sheet, in which desirable corrosion resistance can be obtained after painting. A method of performing pre-paint treatment of an automobile body, the method including performing an alkaline degreasing step, a first water-washing step, a chemical conversion treatment step, a second water-washing step, and a cationic electrodeposition painting step, in this order, wherein the chemical conversion treatment step is performed using an chemical conversion treatment agent including zirconium (A), free fluorine ions (B), an allylamine-diallylamine copolymer (C), aluminum ions (D), nitrate ions (E) each at a predetermined concentration; the allylamine-diallylamine copolymer (C) forms an acid addition salt having an anionic counter ion, and the pKa of an acid thereof falls within the range of −3.7 to 4.8; and the content percentage of diallylamine is 80 mol % or more and 98 mol % or less.

2 Claims, No Drawings

METHOD OF PERFORMING PRE-PAINT TREATMENT OF AUTOMOBILE BODY AND AUTOMOBILE BODY

This application is based on and claims the benefit of priority from Japanese Patent Application No. 2021-060181, filed on Mar. 31, 2021, the content of which is incorporated herein by reference.

BACKGROUND OF THE INVENTION

Field of the Invention

The present invention relates to a method of performing pre-paint treatment of an automobile body, and the automobile body.

Related Art

For cationic electrodeposition painting or powder painting of a metal substrate surface of an automobile body, the metal substrate surface is conventionally subjected to chemical conversion treatment in advance to improve corrosion resistance, coating adhesiveness, and the like. In recent years, chemical conversion treatment is commonly performed with chromium-free zinc phosphate.

Chemical conversion treatment with zinc phosphate may, however, suffer from difficult effluent disposal due to the high reactivities of processing agents. These agents may generate sludge, causing significant environmental load. Accordingly, a chemical conversion treatment agent has been proposed which consists of: at least one selected from the group consisting of zirconium, titanium, and hafnium; fluorine; and a water-soluble resin (for example, see Patent Document 1).

Patent Document 1: Japanese Unexamined Patent Application, Publication No. 2004-218074

SUMMARY OF THE INVENTION

Patent Document 1 discloses a technology which enables good chemical conversion treatment to be performed on a metal such as iron, zinc, and aluminum. Meanwhile, high-tensile steel sheets used in automobile bodies are superior materials with lightweight and strength, but often difficult for chemical conversion treatment. This is because a high-tensile steel sheet may show decreased reactively for a chemical conversion treatment agent due to not only the presence of a thick oxide layer but also the presence of alloying elements such as C, Si, and Mn therein. These may negatively affect on the formation of a cationic electrodeposition coating after chemical conversion treatment. Therefore, it is desired to obtain sufficient corrosion resistance after cationic electrodeposition painting.

The present invention is made in view of the above. An object of the present invention is to provide a method of performing pre-paint treatment of an automobile body including a high-tensile steel sheet, in which desirable corrosion resistance can be obtained after painting.

(1) An embodiment of the present invention provides a method of performing pre-paint treatment of an automobile body, the method including performing an alkaline degreasing step, a first water-washing step, a chemical conversion treatment step, a second water-washing step, and a cationic electrodeposition painting step, in this order, wherein the chemical conversion treatment step is performed using a chemical conversion treatment agent including: zirconium (A); free fluorine ions (B); an allylamine-diallylamine copolymer (C); aluminum ions (D); and nitrate ions (E), the concentration of the zirconium (A) is 50 to 500 ppm by mass in terms of elemental metal relative to the total mass of the chemical conversion treatment agent; the concentration of the free fluorine ion (B) is 5 to 30 ppm by mass relative to the total mass of the chemical conversion treatment agent; the content percentage of a diallylamine segment originating from diallylamine in the allylamine-diallylamine copolymer (C) is 80 mol % or more and 98 mol % or less relative to the total of an allylamine segment originating from allylamine and the diallylamine segment; the allylamine-diallylamine copolymer (C) has a weight average molecular weight of 5000 to 100000 and a concentration of 100 to 350 ppm by mass in terms of the concentration of solid resin relative to the total mass of the chemical conversion treatment agent; the allylamine-diallylamine copolymer (C) is an acid addition salt having an anionic counter ion, and an acid in the acid addition salt has a pKa within a range of −3.7 to 4.8; the concentration of the aluminum ion (D) is 90 to 500 ppm by mass relative to the total mass of the chemical conversion treatment agent; the concentration of the nitrate ion (E) is 2000 to 13000 ppm by mass relative to the total mass of the chemical conversion treatment agent; and the automobile body is made of a material including a high-tensile steel sheet.

(2) The method of performing pre-paint treatment of an automobile body according to (1), wherein the chemical conversion treatment agent has a pH of 3.5 to 5.5.

(3) An automobile body including a material including a high-tensile steel sheet having a film, wherein the concentration of the zirconium (A) in the film formed on the high-tensile steel sheet by the method of performing pre-paint treatment of an automobile body according to claim 1 or 2 is 20 to 200 mg/m$^2$ in terms of elemental metal.

An embodiment of the present invention can provide a method of performing pre-paint treatment of an automobile body including a high-tensile steel sheet, in which desirable corrosion resistance can be obtained after painting.

DETAILED DESCRIPTION OF THE INVENTION

Below, the embodiments of the present invention will be described. The present invention shall not be limited to the descriptions of the following embodiments.

<Method of Performing Pre-Paint Treatment of an Automobile Body>

The method of performing pre-paint treatment of an automobile body according to the present embodiment includes performing an alkaline degreasing step, a first water-washing step, a chemical conversion treatment step, a second water-washing step, and a cationic electrodeposition painting step, in this order, on the automobile body, the automobile body made of a material including a high-tensile steel sheet.

(Alkaline-Degreasing Step)

In the alkaline degreasing step, the high-tensile steel sheet of the automobile body to be treated is immersed in a degreasing agent such as a phosphorus-free and nitrogen-free degreasing cleaning liquid at, for example, 30 to 55° C. for several minutes. Prior to the alkaline degreasing step, preliminary degreasing treatment may be performed.

(First Water-Washing Step)

In the first water-washing step, a degreasing agent is washed out with water after the alkaline degreasing step.

This can be achieved by one or more spray treatments with a large amount of washing water.

(Chemical Conversion Treatment Step)

In the chemical conversion treatment step, a chemical conversion film is formed on the surface of a high-tensile steel sheet of an automobile body, producing a surface-treated steel sheet. A step of forming a chemical conversion film may be performed by contacting the surface of the high-tensile steel sheet with a chemical conversion treatment agent. There is no particular limitation for methods of making contact as described above, but they include, for example, the dipping method, the spray method, the roll coating method, and the like. A treatment temperature in the chemical conversion treatment step may be within the range of 20 to 70° C., preferably within the range of 30 to 50° C. A treatment duration in the chemical conversion treatment step may be within the range of 5 to 1200 seconds, preferably within the range of 30 to 120 seconds. The composition of the chemical conversion treatment agent used in the chemical conversion treatment step will be described below in detail.

(Second Water-Washing Step)

The second water-washing step may be achieved by performing one or more spray treatments or soaked washing in water to the extent so as not to affect adhesiveness, corrosion resistance, and the like after painting. The last water-washing treatment is preferably performed with ion exchanged water or pure water. After the second water-washing step, a step of drying the surface-treated steel sheet may be provided if desired.

(Cationic Electrodeposition Painting Step)

In the cationic electrodeposition painting step, the surface-treated steel sheet prepared in the chemical conversion treatment step is subjected to cationic electrodeposition painting for forming an electrodeposition coating on the surface. There is no particular limitation for a cationic electrodeposition paint for use in cationic electrodeposition painting, but conventionally known cationic electrodeposition paints including aminated epoxy resin, aminated acrylic resin, sulfonium epoxy resin, and the like may be used. There is no particular limitation for methods of performing cationic electrodeposition painting using those cationic electrodeposition paints, but known methods of performing cationic electrodeposition painting can be applied.

<Chemical Conversion Treatment Agent>

The chemical conversion treatment agent according to the present embodiment can form a chemical conversion film on a high-tensile steel sheet of an automobile body, the chemical conversion film providing desirable corrosion resistance after cationic electrodeposition painting.

The chemical conversion treatment agent according to the present invention includes zirconium (A), and a free fluorine ion (B), and an allylamine-diallylamine copolymer (C), and an aluminum ion (D), and a nitrate ion (E).

(Zirconium (A))

The zirconium (A) is a component for forming a chemical conversion film. The formation of a chemical conversion film containing zirconium (A) on the surface of a high-tensile steel sheet can improve the corrosion resistance and abrasion resistance of the high-tensile steel sheet, and can also improve adhesiveness with a cationic electrodeposition coating.

There is no particular limitation for the sources of the zirconium (A), but they include, for example, alkali metal fluorozirconate such as $K_2ZrF_6$, fluorozirconic acid ($H_2ZrF_6$), ammonium hexafluorozirconate ($(NH_4)_2ZrF_6$), ammonium zirconium carbonate ($(NH_4)_2ZrO(CO_3)_2$), tetraalkylammonium denatured zirconium, zirconium fluoride, zirconium oxide, and the like.

The concentration of the zirconium (A) may be 50 to 500 ppm by mass in terms of elemental metal relative to the total mass of the chemical conversion treatment agent. When the concentration of the zirconium (A) is less than 50 ppm, the resulting chemical conversion film cannot provide sufficient performance. When the concentration of the zirconium (A) is more than 500 ppm by mass, no further improvement can be obtained, which is economically disadvantageous. In view of the above, the concentration of the zirconium (A) may be preferably 100 to 500 ppm by mass in terms of elemental metal.

(Free Fluorine Ion (B))

The free fluorine ion (B) has a function of etching the surface of a metal substrate. There is no particular limitation for sources of the free fluorine ion (B), but they include, for example, fluorides such as hydrofluoric acid, ammonium fluoride, fluoroboric acid, ammonium hydrogen fluoride, sodium fluoride, and sodium hydrogen fluoride. Further, fluoride complexes include, for example, hexafluorosilicates, and more specifically, hexafluorosilicic acid, zinc hexafluorosilicate, manganese hexafluorosilicate, magnesium hexafluorosilicate, nickel hexafluorosilicate, iron hexafluorosilicate, and calcium hexafluorosilicate. Fluorine-containing compounds such as alkali metal fluorozirconate exemplified as a source of the zirconium (A) can also serve as a source of the free fluorine ion (B) as well as a source of the zirconium (A).

The concentration of the free fluorine ion (B) may be 5 to 30 ppm by mass relative to the total mass of the chemical conversion treatment agent. When the concentration of the free fluorine ion (B) is less than 5 ppm by mass, etching may be insufficient, and thus a good chemical conversion film cannot be obtained. When it is more than 30 ppm by mass, etching may be excessive, and thus a chemical conversion film cannot be formed sufficiently. The concentration of the free fluorine ion (B) can be measured, for example, with a commercially available fluorine ion meter (for example, IM-32P from DKK-TOA Corporation).

(Allylamine-Diallylamine Copolymer (C))

The allylamine-diallylamine copolymer (C) has at least both of a segment originating from allylamine and a segment originating from diallylamine (hereafter may also be referred to as an "allylamine segment" and a "diallylamine segment", respectively) as structural units. Each of the segments may be each independently in a state of a quaternary compound. Each of the segments may each independently has a counter ion.

The content percentage of a diallylamine segment in the allylamine-diallylamine copolymer (C) according to the present embodiment may be 80 mol % or more and 98 mol % or less. The content percentage of a diallylamine segment is defined as a mol % of the diallylamine segment relative to the total of the allylamine segment and the diallylamine segment in the allylamine-diallylamine copolymer (C). When the content percentage of the diallylamine segment is less than 80 mol %, sufficient corrosion resistance cannot be obtained after painting. When the content percentage of the diallylamine segment is more than 98 mol %, the adhesiveness to a coating of the chemical conversion film may be decreased. In view of the above, the content percentage of the diallylamine segment may also be preferably 90 mol % or more and 98 mol % or more. Examples of the diallylamine segment include, for example, heterocyclic structures represented by the general formulae (1a) and (1b) below. These heterocyclic structures may be saturated.

[Chem. 1]

(1a)

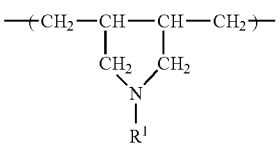

(1b)

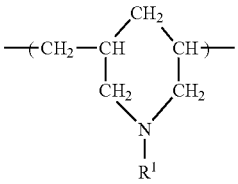

(wherein $R^1$ represents a hydrogen atom, an alkyl group, or an aralkyl group.)

The allylamine segment in the allylamine-diallylamine copolymer (C) may be represented by, for example, the general formula (2) below:

[Chem. 2]

(2)

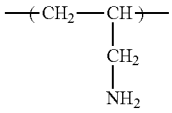

The allylamine-diallylamine copolymer (C) is an acid addition salt having an anionic counter ion for an ammonium cation. The dissociation constant pKa of an acid forming the acid addition salt falls within the range of −3.7 to 4.8. It is noted that the dissociation constant pKa of an acid, as used herein, means a value in water as a solvent at a temperature of 25° C. The diallylamine segment of the allylamine-diallylamine copolymer (C) as an acid addition salt may be represented by, for example, the general formula (1c) or (1d) below:

[Chem. 3]

(1c)

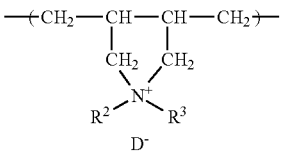

(1d)

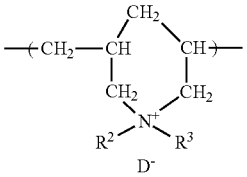

wherein $R^2$ and $R^3$ represent a hydrogen atom, an alkyl group, or an aralkyl group, and $D^-$ represents a monovalent anion.

There is no particular limitation for the anionic counter ion, but it may be a monovalent anion, including a formate ion, an acetate ion, or a carboxylate ion such as a benzoate ion, a chloride ion, a sulfate ion, or a nitrate ion. Examples of an acid in the acid addition salt include organic acids such as formic acid, acetic acid, and benzoic acid; and inorganic acids such as hydrochloric acid, sulfuric acid, and nitric acid.

The allylamine-diallylamine copolymer (C) may have a segment other than the segment originating from allylamine and the diallylamine segment if desired. Examples of such a segment include those originating from, for example, N,N-dialkylaminoalkyl (meth)acrylate and a salt or a quaternary compound thereof; N,N-dialkylaminoalkyl (meth) acrylamide and a salt or a quaternary compound thereof; vinylimidazole and a salt or a quaternary compound thereof; vinylpyridine and a salt or a quaternary compound thereof; N-alkylallylamine and a salt thereof; N,N-dialkylallylamine and a salt thereof; N-alkyldiallylamine and a salt or a quaternary compound thereof; and others.

The allylamine-diallylamine copolymer (C) may further have a segment other than those listed above. For example, the allylamine-diallylamine copolymer (C) may have a segment originating from sulfur dioxide; an unsaturated compound having a hydroxy group, such as 2-hydroxyethyl (meth)acrylate; alkyl (meth)acrylate esters, such as methyl (meth)acrylate and ethyl (meth)acrylate; vinyl carboxylates, such as, vinyl acetate and vinyl propionate; unsaturated acid (meth)acrylamide; and others.

The content percentage of a segment other than a segment originating from allylamine and the diallylamine segment in the allylamine-diallylamine copolymer (C) may be preferably 20% or less, more preferably 10% or less, and most preferably 0%. The content percentage of a segment originating neither from the allylamine nor the diallylamine segments may be defined as a mol % of those corresponding to neither the allylamine segment nor the diallylamine segment to the total of all segments in the allylamine-diallylamine copolymer (C).

The concentration of the allylamine-diallylamine copolymer (C) is 100 to 350 ppm by mass in terms of the concentration of solid resin relative to the total mass of the chemical conversion treatment agent. When the concentration is less than 100 ppm by mass, sufficient adhesiveness of a chemical conversion film cannot be obtained. When it is more than 350 ppm by mass, the formation of a chemical conversion film may be inhibited. In view of the above, the concentration of the allylamine-diallylamine copolymer (C) may be preferably 125 to 300 ppm by mass in terms of the concentration of solid resin.

The weight average molecular weight of the allylamine-diallylamine copolymer (C) may be 5000 to 100000. When the weight average molecular weight is less than 5000, sufficient adhesiveness of a chemical conversion film cannot be obtained. When the weight average molecular weight is more than 100000, the formation of a chemical conversion film may be inhibited. In view of the above, the weight average molecular weight of the allylamine-diallylamine copolymer (C) may be preferably 20000 to 100000.

The weight average molecular weight of the allylamine-diallylamine copolymer (C) can be measured by, for example, gel permeation chromatography (GPC). As a measurement instrument, for example, a Hitachi L-6000 high performance liquid chromatography equipped with an eluent flow pump of Hitachi L-6000 and a detector of a Shodex RI SE-61 differential refractive index detector can be used along with doubly connected columns of an Asahi Pack aqueous gel filtration GS-220HQ (exclusion limit molecular weight: 3,000) and a GS-620HQ (exclusion limit molecular weight: 2,000,000). An exemplary GPC measurement method is described below. A sample is adjusted to a concentration of 0.5 g/100 ml with an eluent, of which 20 μl is used. A 0.4-mol/L aqueous solution of sodium chloride is used as an eluent. It runs at a column temperature of 30° C. with a flow rate of 1.0 ml/min. Polyethylene glycols such as those having a molecular weight of 106, 194, 440, 600, 1470, 4100, 7100, 10300, 12600, and 23000 are used as standard samples to obtain a calibration curve. The weight average molecular weight (Mw) of a copolymer can be calculated based on the calibration curve.

The allylamine-diallylamine copolymer (C) may be modified to the extent that the purpose of the present invention is not impaired. For example, some of the amino groups of the allylamine-diallylamine copolymer (C) may be modified by those methods such as acetylation, or may be cross-linked via a cross-linking agent to the extent that the solubility is not affected.

There is no particular limitation for a method of preparing the allylamine-diallylamine copolymer (C), but for example, a method may be mentioned including performing radical polymerization of a monomer mixture of allylamine, diallylamine, and optionally other components in an appropriate solvent in the presence of a radical polymerization initiator. Appropriate polymerization conditions can be selected from those known to a person skilled in the art.

(Other Macromolecules)

The chemical conversion treatment agent according to the present embodiment may contain a macromolecule other than the allylamine-diallylamine copolymer (C). Macromolecules other than the allylamine-diallylamine copolymer (C) include those such as polyallylamine resin, polyvinylamine resin, polydiallylamine resin, urethane resin, acrylic resin, polyester resin, and derivatives of naturally-occurring macromolecules such as chitin/chitosan derivatives and cellulose derivatives. When the chemical conversion treatment agent according to the present embodiment contains a macromolecule other than the allylamine-diallylamine copolymer (C), the solid content by mass of the allylamine-diallylamine copolymer (C) may be preferably 80% by mass or more, more preferably 90% by mass or more, and most preferably 95% by mass or more relative to the total solid content by mass of all macromolecules.

(Aluminum Ion (D))

The aluminum ion (D) may be included in the chemical conversion treatment agent to further improve corrosion resistance after cationic electrodeposition painting. There is no particular limitation for sources of the aluminum ion (D), but they include oxides, hydroxides, fluorides, chlorides, sulfates, nitrates, borates, carbonates, and organic acid salts of aluminum. The concentration of the aluminum ion (D) may be 90 to 500 ppm by mass, preferably 90 to 350 ppm by mass relative to the total mass of the chemical conversion treatment agent.

(Nitrate Ion (E))

The nitrate ion (E) can act as an oxidizing agent for promoting a reaction of forming a chemical conversion film. Sources of the nitrate ion (E) include nitric acid, sodium nitrate, potassium nitrate, ammonium nitrate, and the like in addition to nitrates of aluminum as described above and a nitrate ion as an anionic counter ion of the allylamine-diallylamine copolymer (C). The concentration of the nitrate ion (E) may be 2000 to 13000 ppm by mass, preferably 3000 to 12000 ppm by mass relative to the total mass of the chemical conversion treatment agent.

(Other Components)

Preferably, the chemical conversion treatment agent according to the present embodiment may further contain a silane coupling agent. Inclusion of a silane coupling agent in the chemical conversion treatment agent can further improve the coating adhesiveness of a chemical conversion film. There is no particular limitation for the silane coupling agent, but it may preferably be one or more silane coupling agents selected from, for example, amino group-containing silane coupling agents, epoxy group-containing silane coupling agents, hydrolysates of amino group-containing silane coupling agents, hydrolysates of epoxy-group containing silane coupling agents, polymers of amino group-containing silane coupling agents, and polymers of epoxy group-containing silane coupling agents.

There is no particular limitation for the amino group-containing silane coupling agents, but they can include, for example, known silane coupling agents such as N-2(aminoethyl)3-aminopropylmethyldimethoxysilane, N-2(aminoethyl)3-aminopropyltrimethoxysilane, N-2(aminoethyl)3-aminopropyltriethoxysilane, 3-aminopropyltrimethoxysilane, 3-aminopropyltriethoxysilane, 3-triethoxysilyl-N-(1,3-dimethyl-butylidene)propylamine, N-phenyl-3-aminopropyltrimethoxysilane, and N,N-bis[3-(trimethoxysilyl)propyl]ethylenediamine, and others. Commercially available amino group-containing silane coupling agents KBM-602, KBM-603, KBE-603, KBM-903, KBE-9103, KBM-573 (all are from Shin-Etsu Chemical Co., Ltd.), XS1003 (from Chisso Corporation), and others may also be used.

There is no particular limitation for the aforementioned epoxy group-containing silane coupling agents, but they can include, for example, 3-glycidoxypropyltrimethoxysilane, 3-glycidoxypropyltriethoxysilane, 3-glycidoxypropylmethyldimethoxysilane, 3-glycidoxypropylmethyldiethoxysilane, 3-glycidoxypropyldiethylethoxysilane, 2-(3,4-epoxycyclohexyl)ethyltrimethoxysilane, 2-(3,4-epoxycyclohexyl)ethyltriethoxysilane, 5,6-epoxyhexyltriethoxysilane, and others. Commercially available "KBM-403", "KBE-403", "KBE-402", "KBM-303" (all are from Shin-Etsu Chemical Co., Ltd.), and others can also be used.

The chemical conversion treatment agent according to the present embodiment may contain a component other than those described above. For example, it may be preferred to further contain zinc as a component for forming chemical conversion film. This can further improve the corrosion resistance of a metal substrate on which a chemical conversion film is formed. At least one metal component selected from the group consisting of magnesium, calcium, gallium, indium, and copper may be included as a component for forming a chemical conversion film, other than those described above. At least one metal component selected from the group consisting of manganese, iron, cobalt, nickel, and chromium may also further be included. There is no particular limitation for sources of the component for forming a chemical conversion film, but they include oxides, hydroxides, fluorides, chlorides, sulfates, nitrates, borates, carbonates, organic acid salts of each metal. The aforementioned sources may be included in the chemical conversion treatment agent as eluted components from a metal substrate to be subjected to chemical conversion treatment in a chemical conversion treatment bath.

The chemical conversion treatment agent according to the present embodiment may contain an oxidizing agent other than the nitrate ion (E). This can promote the formation of a chemical conversion film to further improve the corrosion resistance of a metal substrate. With regard to the oxidizing agent, an inorganic acid or a salt thereof is thought to promote a reaction of forming a chemical conversion film as an oxidizing agent. Examples of such an inorganic acid can include nitric acid, nitrous acid, hydrochloric acid, bromic acid, chloric acid, hydrogen peroxide, $HMnO_4$, $HVO_3$, and others. It is noted that sulfonate group-containing compounds or salts thereof may be included as oxidizing agents in a composition for treating a metal surface. An inorganic acid or a salt thereof is thought to promote a reaction of forming a chemical conversion film as an oxidizing agent. Examples of such an inorganic acid can include nitric acid, nitrous acid, hydrochloric acid, bromic acid, chloric acid, hydrogen peroxide, $HMnO_4$, $HVO_3$, and others. It is noted that sulfonate group-containing compounds or salts thereof may be included as oxidizing agents in a composition for treating a metal surface. An inorganic acid or a salt may be mentioned. Examples of such an inorganic acid can include hydrochloric acid, bromic acid, chloric acid, hydrogen peroxide, $HMnO_4$, $HVO_3$, and others. It is noted that sulfonate group-containing compounds or salts thereof may be included as oxidizing agents in the chemical conversion treatment agent.

The chemical conversion treatment agent according to the present embodiment may be preferably one which does not substantially contain phosphate ions. The phrase "does not substantially contain phosphate ions" means that phosphate ions are not included in an amount such that they act as a component in the chemical conversion treatment agent. The chemical conversion treatment agent according to the present embodiment does not substantially contain phosphate ions, and thus phosphorus responsible for environmental burden is not substantially used. In addition, the generation of sludge can be controlled such as iron phosphate, zinc phosphate, and the like which are generated when a treatment agent of zinc phosphate is used.

(pH)

The chemical conversion treatment agent preferably has a pH of 3.5 to 5.5. When it has a pH of less than 3.5, etching may be excessive, and a chemical conversion film cannot be formed sufficiently. When it has a pH of more than 5.5, etching may be insufficient, and a good chemical conversion film cannot be obtained. In view of the above, the chemical conversion treatment agent preferably has a pH of 4.0 to 4.5. In order to adjust the pH of the chemical conversion treatment agent, an acidic compound such as nitric acid and sulfuric acid, and a basic compound such as sodium hydroxide, potassium hydroxide, and ammonia may be used.

<Automobile Body Made of Material Including High-Tensile Steel Sheet>

A chemical conversion film can be formed on the surface of an automobile body made of a material including a high-tensile steel sheet by the chemical conversion treatment agent according to the present embodiment. The chemical conversion treatment agent according to the present embodiment can confer sufficient corrosion resistance even on a high-tensile steel sheet to which it is difficult to provide sufficient corrosion resistance using a conventional chemical conversion treatment agent. A high-tensile steel sheet means a steel sheet having a tensile strength equal to or higher than a certain level. High-tensile steel sheets include, for example, high-tensile hot-rolled steel sheets, high-tensile cold-rolled steel sheets, high-tensile galvanized sheet sheets, and the like.

An automobile body as painting target to be treated by the method of performing pre-paint treatment of an automobile body according to the present embodiment is at least in part made of a high-tensile steel sheet. The automobile body may be entirely made of a high-tensile steel sheet, or may have a portion made of a high-tensile steel sheet and a portion made of a steel sheet other than a high-tensile steel sheet. Examples of a steel sheet other than a high-tensile steel sheet which can be used to constitute a painting target include, for example, cold-rolled steel sheets, hot-rolled steel sheets, stainless steel, zinc or zinc-based alloy plated steel sheets, and the like. Zinc or zinc-based alloy plated steel sheets include, for example, zinc or zinc-based alloy plated steel sheets such as electroplated, hot-dipped, vapor-deposited zinc-based steel sheets such as galvanized steel sheets, zinc-nickel plated steel sheets, zinc-iron plated steel sheets, zinc-chromium plated steel sheets, zinc-aluminum plated steel sheets, zinc-titanium plated steel sheets, zinc-magnesium plated steel sheets, and zinc-manganese plated steel sheets.

The automobile body made of a material including a high-tensile steel sheet according to the present embodiment preferably has a content of the zirconium (A) of 20 to 200 $mg/m^2$ in terms of elemental metal in a film formed with the chemical conversion treatment agent on the surface of the high-tensile steel sheet. When the content of the metal component (A) is less than 20 $mg/m^2$, a uniform chemical conversion film cannot be obtained. When the content of the metal component (A) is more than 200 $mg/m^2$, no further improvement can be obtained, which is economically disadvantageous.

EXAMPLES

Below, the present invention is described in more detail with reference to Examples. The scope of the present invention shall not be limited to the descriptions of the following Examples.

Example 1

A commercially available high-tensile steel sheet (from Standard-testpiece Co., Ltd., 7 cm×15 cm×0.1 cm) was used as a substrate to perform surface treatment under the following conditions.

In the alkaline degreasing step, the sheet was subjected to immersion treatment at 40° C. for 2 minutes in 2% by mass of "Surfcleaner EC90" (a degreasing agent from Nippon Paint Surf Chemicals Co., Ltd.). In the first water-washing step, spray treatment with tap water was performed for 30 seconds. In the chemical conversion treatment step, fluorozirconic acid, acidic sodium fluoride, a allylamine-diallylamine copolymer (allylamine segment: 20 mol %, diallylamine segment: 80 mol %, weight average molecular weight: 5000, a salt of acetic acid (pKa 4.8)), aluminum nitrate nonahydrate, and sodium nitrate were used to prepare a chemical conversion treatment agent so that the concentration of Zr was 50 ppm by mass in terms of elemental metal, and the concentration of free fluoride ion was 15 ppm by mess, and the concentration of the allylamine-diallylamine copolymer was 100 ppm by mass in terms of the concentration of solid resin as shown in Table 1. pH was adjusted to 4.0 using sodium hydroxide. The temperature of the chemical conversion treatment agent was adjusted to 40° C., and the substrate was subjected to immersion treatment for 120 seconds.

In the second water-washing step, spray treatment with tap water was performed for 30 seconds. Spray treatment was further performed with ion exchange water for 30 seconds. In a subsequent drying treatment, it was dried in an electric drying furnace at 80° C. for 5 minutes. The content ($mg/m^2$) of zirconium in the chemical conversion treatment film was measured with a "ZSX PrimusII" (an X-ray analyzer from Rigaku Corporation). The results are shown in Table 1.

In the cationic electrodeposition coating formation step, cationic electrodeposition painting was performed with "POWERNIX 1050" (a cationic electrodeposition paint from Nippon Paint Automotive Coatings Co., Ltd.) so as to obtain a dry coating thickness of 20 μm. After washing with water, it was baked at 170° C. for 20 minutes to produce a test plate for use in Example 1.

Examples 2 to 11, Comparative Examples 1 to 13 Test plates for use in these Examples and Comparative Examples were produced as in Example 1 except that the compositions of the chemical conversion treatment agents used in the chemical conversion treatment step were as shown in Table 1. The detailed compositions of the chemical conversion treatment agents used in these Examples and Comparative Examples are as follows.

The following commercially available products were used as the allylamine-diallylamine copolymer (C) in the following Examples and Comparative Examples. In Comparative Example 9, a diallylamine copolymer was used in place of the allylamine-diallylamine copolymer (C). Example 3, Comparative Example 5: "PAA-D19-A", Examples 8, 10, and Comparative Example 1: "PAA-D19-HCL", Comparative Example 7: "PAA-D41-HCl", Comparative Example 8: "PAA-D11-HCl", Comparative Example 9: "PAS-21" (all are from Nittobo Medical Co., Ltd.) In Examples and Comparative Examples, hydrochloric acid was used as an acid having a pKa of −3.7 in an acid addition salt.

[Peeling Off Width Test after Hot Salt Dip Test (SDT)]

The test plates for Examples and Comparative Examples were cross-cut to reach the base material, and then immersed into a 5 mass % NaCl solution at 55° C. for 240 hours. Then, they were washed with tap water, and further dried at ordinary temperature. Subsequently, Sellotape Tape® peeling off width tests were performed on the cross-cut portion of an electrodeposited coating, and the maximum peeling off width at one side from the cross-cut was measured. Results were scored according to the following criteria. A score of 2 or higher was considered as acceptable. The results are shown in Table 1.

3: less than 1.0 mm
2: 1.0 mm or more and less than 2.5 mm
1: 2.5 mm or more

[Total Area of Blister on General Surface after Hot Salt Dip Tests (SDT)]

For the test plates used in Examples and Comparative Examples, the plates were painted by cationic electrodeposition, and then immersed into a 5 mass % NaCl solution at 55° C. for 240 hours. Then, they were washed with tap water, and further dried at ordinary temperature. Subsequently, the percentage of the total area of blister occurred on the general surface of an electrodeposition coating was measured. Results were scored according to the following criteria. A score of 3 or higher was considered as acceptable. The results are shown in Table 1.

3: 0%
2: more than 0% and less than 1.0%
1: 1.0% or more

[Cyclic Corrosion Test (CCT)]

The test plates for Examples and Comparative Examples were cross-cut to reach the base material, and then subjected to the cyclic corrosion test. The test method was as follows: 50 cycles were performed with each cycle including a cyclic corrosion test conducted in accordance with the following conditions.

| | |
|---|---|
| Wetting | 40° C., 95% RH, 2 hours |
| Spraying salt water | 35° C., 5% NaCl, 2 hours |
| Drying | 60° C., 1 hour |
| Wetting | 50° C., 95% RH, 6 hours |
| Drying | 60° C., 2 hours |
| Wetting | 50° C., 95% RH, 6 hours |
| Drying | 60° C., 2 hours |
| Low temperature | −20° C., 3 hours |

After the above CCT tests, the maximum swelling width at the both side from the cut portion was measured. Results were scored according to the following criteria. A score of 3 or higher was considered as acceptable. The results are shown in Table 1.

4: less than 3.0 mm
3: 3.0 mm or more and less than 3.5 mm
2: 3.5 mm or more and less than 4.0 mm
1: 4.0 mm or more

TABLE 1

| | | Chemical conversion treatment agent | | | | | | | | | Chemical | Evaluation | | |
|---|---|---|---|---|---|---|---|---|---|---|---|---|---|---|
| | | Zirconium (A) | | Free fluoride ion (B) | Allylamine-diallylamine copolymer (C) | | | | aluminum ion (D) | nitrate ion (E) | conversion film | SDT peel | | |
| | | Type | [ppm by mass] | [ppm by mass] | Weight-average molecular weight | Diallylamine segment (mol %) | pKa of an acid in acid addition salt | [ppm by mass] | [ppm by mass] | [ppm by mass] | pH | Amount of Zr coating [mg/m$^2$] | off from cross cut | SDT blister | CCT |
| Examples | 1 | Zr | 50 | 15 | 5000 | 80 | 4.8 | 100 | 180 | 7000 | 4.0 | 42 | 3 | 3 | 3 |
| | 2 | Zr | 100 | 7.5 | 100000 | 98 | 4.8 | 100 | 90 | 2000 | 4.0 | 49 | 3 | 3 | 3 |
| | 3 | Zr | 200 | 10 | 60000 | 95 | 4.8 | 150 | 400 | 10000 | 4.0 | 44 | 3 | 3 | 4 |
| | 4 | Zr | 200 | 5 | 40000 | 90 | 4.8 | 350 | 200 | 4000 | 4.0 | 56 | 3 | 3 | 3 |
| | 5 | Zr | 300 | 15 | 20000 | 80 | −3.7 | 300 | 350 | 6000 | 4.0 | 42 | 3 | 3 | 3 |
| | 6 | Zr | 300 | 25 | 60000 | 98 | −3.7 | 300 | 120 | 3000 | 4.0 | 33 | 3 | 3 | 3 |
| | 7 | Zr | 400 | 30 | 50000 | 90 | −3.7 | 150 | 500 | 10000 | 4.0 | 29 | 3 | 3 | 3 |
| | 8 | Zr | 500 | 10 | 40000 | 95 | −3.7 | 150 | 250 | 5000 | 4.0 | 50 | 3 | 3 | 3 |
| | 9 | Zr | 400 | 20 | 30000 | 80 | 4.8 | 150 | 150 | 12000 | 4.0 | 39 | 3 | 3 | 3 |
| | 10 | Zr | 200 | 20 | 40000 | 95 | −3.7 | 200 | 200 | 8000 | 4.0 | 45 | 3 | 3 | 4 |
| | 11 | Zr | 400 | 15 | 50000 | 90 | −3.7 | 200 | 90 | 9000 | 4.0 | 40 | 3 | 3 | 4 |
| Comparative Examples | 1 | Zr | 25 | 10 | 40000 | 95 | −3.7 | 300 | 100 | 8000 | 4.0 | 23 | 1 | 1 | 1 |
| | 2 | Zr | 400 | 2.5 | 60000 | 90 | 4.8 | 50 | 400 | 7000 | 4.0 | 78 | 3 | 2 | 1 |
| | 3 | Zr | 100 | 35 | 20000 | 80 | −3.7 | 300 | 300 | 12000 | 4.0 | 19 | 1 | 1 | 1 |
| | 4 | Zr | 75 | 15 | — | — | — | 0 | 100 | 6000 | 4.0 | 89 | 1 | 1 | 1 |

TABLE 1-continued

| | Chemical conversion treatment agent | | | | | | | | | Chemical | Evaluation | | |
|---|---|---|---|---|---|---|---|---|---|---|---|---|---|
| | Zirconium (A) | | Free fluoride ion (B) | Allylamine-diallylamine copolymer (C) | | | | aluminum ion (D) | nitrate ion (E) | | | | |
| | Type | [ppm by mass] | [ppm by mass] | Weight-average molecular weight | Diallylamine segment (mol %) | pKa of an acid in acid addition salt | [ppm by mass] | [ppm by mass] | [ppm by mass] | pH | conversion film Amount of Zr coating [mg/m$^2$] | SDT peel off from cross cut | SDT blister | CCT |
| 5 | Zr | 500 | 15 | 40000 | 95 | 4.8 | 25 | 50 | 3000 | 4.0 | 82 | 1 | 1 | 1 |
| 6 | Zr | 150 | 20 | 60000 | 90 | 4.8 | 500 | 200 | 9000 | 4.0 | 31 | 3 | 1 | 3 |
| 7 | Zr | 400 | 20 | 5000 | 20 | — | 250 | 400 | 10000 | 4.0 | 67 | 3 | 1 | 1 |
| 8 | Zr | 200 | 15 | 70000 | 50 | −3.7 | 100 | 300 | 4000 | 4.0 | 76 | 2 | 1 | 1 |
| 9 | Zr | 300 | 25 | 5000 | 100 | — | 100 | 100 | 12000 | 4.0 | 29 | 1 | 2 | 2 |
| 10 | Zr | 100 | 20 | 100000 | 98 | 4.8 | 300 | 500 | 15000 | 4.0 | 35 | 3 | 3 | 2 |
| 11 | Zr | 500 | 20 | 30000 | 80 | −3.7 | 50 | 300 | 1500 | 4.0 | 53 | 1 | 1 | 1 |
| 12 | Zr | 100 | 25 | 5000 | 80 | 4.8 | 150 | 80 | 4000 | 4.0 | 40 | 3 | 3 | 2 |
| 13 | Zr | 400 | 10 | 40000 | 90 | 4.8 | 100 | 600 | 10000 | 4.0 | 60 | 3 | 2 | 3 |

The results in Table 1 demonstrate that all of the chemical conversion treatment agents according to Examples provide desirable corrosion resistance after cationic electrodeposition painting as compared with the chemical conversion treatment agents from Comparative Examples.

What is claimed is:

1. A method of performing pre-paint treatment of an automobile body, the method comprising performing an alkaline degreasing step, a first water-washing step, a chemical conversion treatment step, a second water-washing step, and a cationic electrodeposition painting step, in this order, wherein the chemical conversion treatment step is performed using a chemical conversion treatment agent comprising:

zirconium (A);

free fluorine ions (B);

an allylamine-diallylamine copolymer (C);

aluminum ions (D); and nitrate ions (E), the concentration of the zirconium (A) is 50 to 500 ppm by mass in terms of elemental metal relative to the total mass of the chemical conversion treatment agent;

the concentration of the free fluorine ions (B) is 5 to 30 ppm by mass relative to the total mass of the chemical conversion treatment agent;

the content percentage of a diallylamine segment originating from diallylamine in the allylamine-diallylamine copolymer (C) is 80 mol % or more and 98 mol % or less relative to the total of an allylamine segment originating from allylamine and the diallylamine segment;

the allylamine-diallylamine copolymer (C) has a weight average molecular weight of 5000 to 100000 and a concentration of 100 to 350 ppm by mass in terms of the concentration of solid resin relative to the total mass of the chemical conversion treatment agent;

the allylamine-diallylamine copolymer (C) is an acid addition salt having an anionic counter ion, and an acid in the acid addition salt has a pKa within a range of −3.7 to 4.8;

the concentration of the aluminum ions (D) is 90 to 500 ppm by mass relative to the total mass of the chemical conversion treatment agent;

the concentration of the nitrate ions (E) is 2000 to 13000 ppm by mass relative to the total mass of the chemical conversion treatment agent; and the automobile body is made of a material comprising a high-tensile steel sheet.

2. The method of performing pre-paint treatment of an automobile body according to claim 1, wherein the chemical conversion treatment agent has a pH of 3.5 to 5.5.

* * * * *